US008246527B2

(12) United States Patent
Wilkinson

(10) Patent No.: US 8,246,527 B2
(45) Date of Patent: Aug. 21, 2012

(54) SYSTEMS AND METHODS FOR FOLDING

(75) Inventor: Richard W. Wilkinson, Friendswood, TX (US)

(73) Assignee: J&L Group International, LLC, Keithville, LA (US)

( * ) Notice: Subject to any disclaimer, the term of this patent is extended or adjusted under 35 U.S.C. 154(b) by 455 days.

(21) Appl. No.: 12/603,361

(22) Filed: Oct. 21, 2009

(65) Prior Publication Data

US 2011/0092350 A1 Apr. 21, 2011

(51) Int. Cl.
*B31B 1/26* (2006.01)

(52) U.S. Cl. ..... 493/162; 493/70; 493/183

(58) Field of Classification Search ..... 493/162, 493/68, 69, 70, 79, 80, 183
See application file for complete search history.

(56) References Cited

U.S. PATENT DOCUMENTS 4,206,691 A * 6/1980 Lines ..... 493/162
4,432,745 A * 2/1984 Eldridge ..... 493/10
4,460,349 A * 7/1984 Charron ..... 493/163
4,524,560 A * 6/1985 Goodman ..... 53/377.3
4,539,002 A * 9/1985 Zak ..... 493/23
5,148,654 A * 9/1992 Kisters ..... 53/462
5,549,537 A * 8/1996 Focke et al. ..... 493/162
5,632,713 A * 5/1997 Canning et al. ..... 493/162
5,971,906 A 10/1999 Tharpe, Jr. et al.
6,226,965 B1 * 5/2001 Lam ..... 53/491
6,322,486 B1 * 11/2001 Waechter ..... 493/70
6,622,461 B2 9/2003 Gambetti
6,881,180 B2 * 4/2005 Ammons et al. ..... 493/183
7,216,468 B2 * 5/2007 Goodman ..... 53/491
7,470,226 B1 12/2008 Herrin
7,494,044 B2 2/2009 Walsh et al.

* cited by examiner

*Primary Examiner* — Sameh H. Tawfik
(74) *Attorney, Agent, or Firm* — Dorsey & Whitney, LLP; Kenneth E. Levitt, Esq.

(57) ABSTRACT

A folding system for folding leading and/or trailing flaps of container blanks is provided. The system may include a conveyor having a conveying surface configured for conveying the blank along a predetermined path to a first folding position and a second folding position, a folding apparatus, and a control system. The folding apparatus may include a drive assembly and a folding tool. The control system may be operatively coupled to the folding apparatus and operable to control movement of the folding tool between a first rotational position and a second rotational position. Rotation of the folding tool to the first rotational position may cause the leading flap of the container blank positioned in the first folding position to fold about a leading flap fold line. Rotation of the folding tool from the first rotational position to the second rotational position may cause the trailing flap of the container blank positioned in the second folding position to fold about a trailing flap fold line.

8 Claims, 13 Drawing Sheets

SYSTEMS AND METHODS FOR FOLDING

FIELD OF THE INVENTION

The present disclosure relates to systems and methods for automated folding. More particularly, the present disclosure relates to systems and methods for automated folding of the leading and trailing flaps of container blanks.

BACKGROUND

Products are commonly packaged in boxes, containers, or cartons (collectively referred to as "containers"). A container generally begins as a container blank, which is generally formed from a sheet of paperboard material, although other materials may be used. A container blank may include various score or fold lines about which the blank is to be folded, according to the desired configuration of the container to be formed from the blank. After a container blank is formed, it may be converted into an erected container.

Container erecting operations may be carried out on high-speed automated machinery. Typically, one of the first operations performed by this machinery is to fold the leading and trailing flaps of a container blank about their respective fold lines. Current automated systems perform the folding operations associated with the leading flap with a first piece of tooling, and the trailing flaps with a second piece of tooling, the second piece of tooling being at a separate location on the conveying system from first piece of tooling.

Heretofore, no automated system has been developed for folding the leading and trailing flaps of a container blank using an integrated piece of tooling or at a single integrated location on a conveying system.

BRIEF SUMMARY OF THE INVENTION

In some embodiments, a folding system for folding leading and/or trailing flaps of container blanks is provided. The system may include a conveyor having a conveying surface configured for conveying the blank along a predetermined path to a first folding position and a second folding position, a folding apparatus, and a control system. The folding apparatus may comprise a drive assembly and a folding tool, wherein the drive assembly comprises a drive mechanism operatively coupled to a rotatable shaft, and wherein the folding tool is secured to the rotatable shaft. The control system may be operatively coupled to the folding apparatus and operable to control movement of the folding tool between a first rotational position and a second rotational position, wherein rotation of the folding tool to the first rotational position causes the leading flap of the container blank positioned in the first folding position to fold about a leading flap fold line, and rotation of the folding tool from the first rotational position to the second rotational position causes the trailing flap of the container blank positioned in the second folding position to fold about a trailing flap fold line.

BRIEF DESCRIPTION OF THE DRAWINGS

While the specification concludes with claims particularly pointing out and distinctly claiming the subject matter that is regarded as forming the present invention, it is believed that the invention will be better understood from the following description taken in conjunction with the accompanying Figures, in which:

DETAILED DESCRIPTION

The present disclosure relates to systems and methods for automated folding. More particularly, the present disclosure relates to systems and methods for automated folding of the leading and trailing flaps of container blanks.

The systems and methods disclosed herein may be used, for example, by manufacturers/users of corrugated paper products to more efficiently erect container blanks. For example, the systems and methods disclosed herein may increase the rate at which the blanks are formed, as well as simplify setup of the machinery used to carryout the folding operations.

Figure 1:
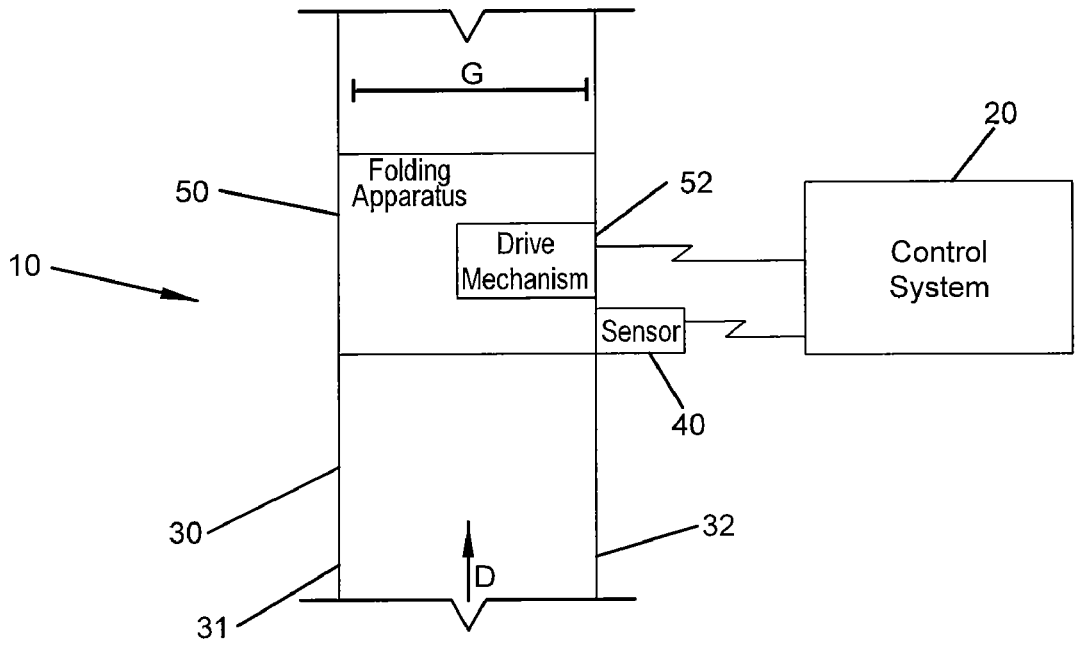
FIG. 1 is a schematic view of an exemplary system environment for carrying out the systems and methods of the present disclosure.

FIG. 1 depicts a schematic view of a folding system 10 according to some embodiments. The folding system 10 may be suitable for practicing various methods, which will be described in more detail below. The folding system 10 may include a control system 20, a conveyor 30, one or more sensors 40, and a folding apparatus 50, which may include a drive assembly 52.

In various embodiments, the control system 20 may include any computer known to those skilled in the art, including standard attachments and components thereof (e.g., processor, memory, sound board, input device, monitor, and the like). The computer may include software programs or instructions stored in the memory, which are executed by the processor. The computer may be in operative communication with, for example, the sensors 40, to receive signals regarding the position of container blanks on the conveyor 30, and the folding apparatus 50, to transmit instructions to effect operations of the folding apparatus 50.

In illustrative embodiments, the control system 20 may be programmed to cause the folding apparatus 50 to selectively contact portions of container blanks. For example, the control system 20 may be programmed to cause the folding apparatus to strike portions of container blanks corresponding to the leading and trailing flaps of the container blanks such that the flaps may be rotated about their respective fold lines. In addition to strike location, the control system 20 may be programmed to control additional strike characteristics such as, for example, the angle of the strike. The control system 20 may be further programmed to accommodate container blanks having variations in dimensions and/or geometry, such as by entering of dimensional characteristics of the container blanks, such as, for example, length of the blank, length of one or more blank flaps, and the like. The control system 20 also may be programmed to accommodate different types of material, including those with different levels of resistance to folding, different levels of resistance to tearing, different thicknesses, etc.

Alternatively or in addition to the computer, the control system 20 may mechanically and/or electronically interface with the folding apparatus 50. For example, a mechanical timer may be configured for detecting the presence of a container blank at predetermined locations on the conveyor 30 and actuating the folding apparatus 50 after some predetermined period and/or in some predetermined interval. Alternatively, or in addition, an electronic timer may operatively direct the folding apparatus 50, such as based on the spacing and line speed of the blanks, and/or based on a signal that is correlated to the blank's position and/or timing on the conveyor 30. The predetermined periods and/or intervals may be determined, for example, on the basis of the dimensions of the container blank, the speed of the conveyor, and the like.

In some embodiments, the conveyor 30 may be configured and operable for moving container blanks. In one embodiment, the conveyor 30 may extend longitudinally from upstream in the downstream direction D, along which container blanks are transported in individual succession from upstream in the downstream direction. The conveyor 30 may include two longitudinal support rails 31, 32 extending from upstream in the downstream direction, which may be generally transversely spaced in order to configure therebetween a longitudinal gap G. A plane defined by a completely unerected container blank lying substantially flat on the support rails 31, 32 may be hereinafter referred to as the "board plane."

In illustrative embodiments, one or more sensors 40 may be positioned proximate the conveyor 30 for sensing the position of a container blank on the conveyor 30. The sensors 40 may be in communication with the control system 20 for communicating information regarding the position of container blanks, such as for providing a signal to the control system 20 for a timely directed movement of the folding apparatus 50. For example, in one embodiment, the sensors 40 may be positioned and configured to detect at least a leading edge and a trailing edge of a container blank being transported on the conveyor 30.

In some embodiments, the folding apparatus 50 may be operable to selectively contact portions of container blanks such as, for example, container blank flaps. The folding apparatus 50 may include one or more folding tools and a drive assembly 52, to which the folding tools may be operatively secured. The drive assembly may, for example, include a rotatable shaft operatively coupled to a drive mechanism such as a servo motor. Alternatively, the drive assembly 52 may include any component or combination of components suitable for selective rotation of a folding tool secured thereon. As previously discussed, the drive assembly 52 may receive instructions from the control system 20 that cause the drive assembly 52 to perform specified functions, such as selective rotation of a shaft of the drive assembly 52.

Figure 2:
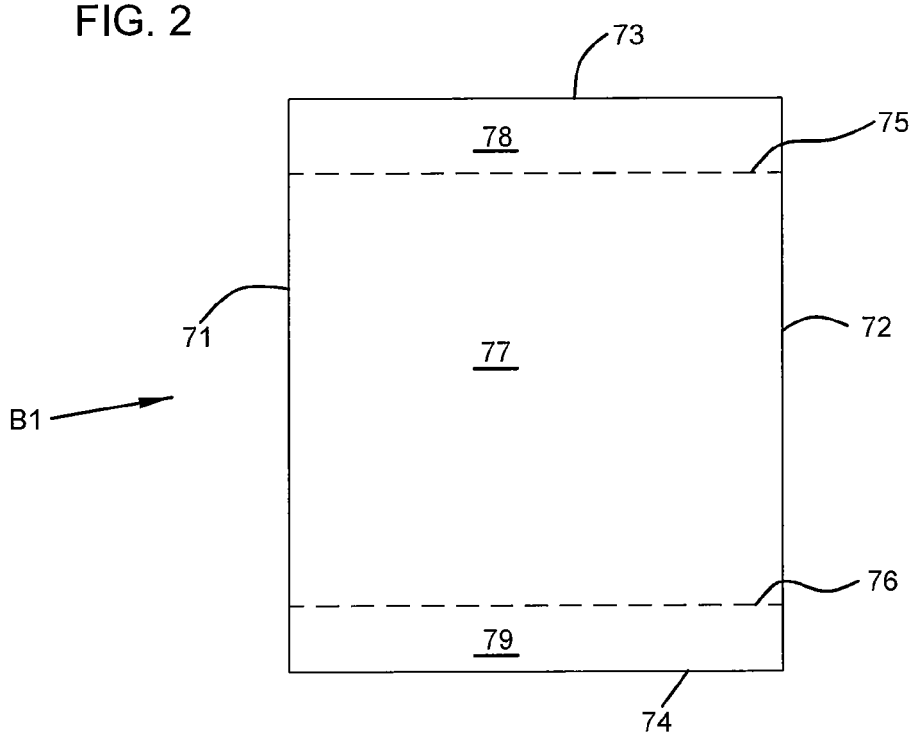
FIG. 2 is a plan view of a container blank suitable for practicing the systems and methods disclosed herein according to some embodiments.
Figure 3:
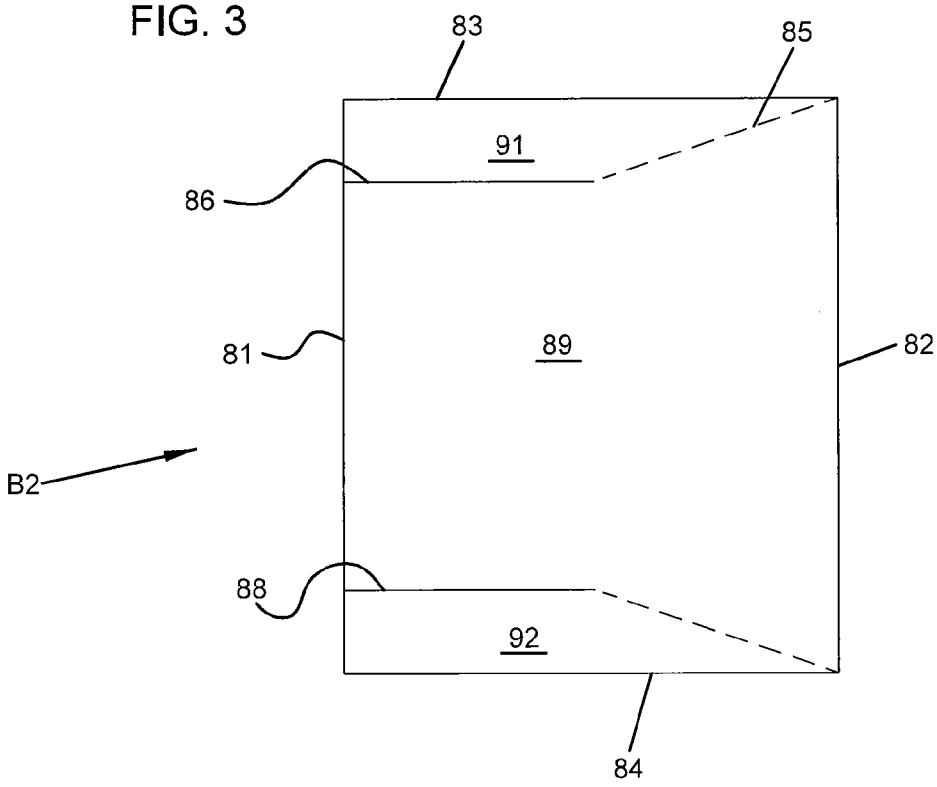
FIG. 3 is a plan view of a container blank suitable for practicing the systems and methods disclosed herein according to some embodiments.

Referring to FIGS. 2-3, depicted are exemplary container blanks suitable for practicing the methods disclosed herein according to various embodiments. The blanks can be generally described as having a plurality of cuts and/or fold lines defining a plurality of flaps and/or panels. As shown, container blank B1 may have a generally rectangular configuration having a first pair of substantially parallel opposing edges 71, 72, and a second pair of substantially parallel opposing edges 73, 74 generally perpendicular to the first pair of edges 71, 72. A front fold line 75 and a rear fold line 76 may divide the blank B1 into a central panel 77, leading flap 78, and a trailing flap 79. The second pair of substantially parallel opposing edges 73, 74 may be referred to as the leading and trailing edges, respectively. Blank B2 may, for example, have a generally rectangular configuration having a first pair of substantially parallel opposing edges 81, 82, and a second pair of substantially parallel opposing edges 83, 84 perpendicular to the first pair of edges 81, 82. A front fold line 85, front cut line 86, rear fold line 87, and rear cut line 88 may divide the blank B2 into a central panel 89, a leading flap 91, and a trailing flap 92. It is to be appreciated that blanks B1 and B2 are provided by way of example, and that container blanks having any configuration and any number of scored fold lines and/or cuts provided in any orientation and defining any number of flaps may be employed without deviating from the scope of the present disclosure.

Figure 4:
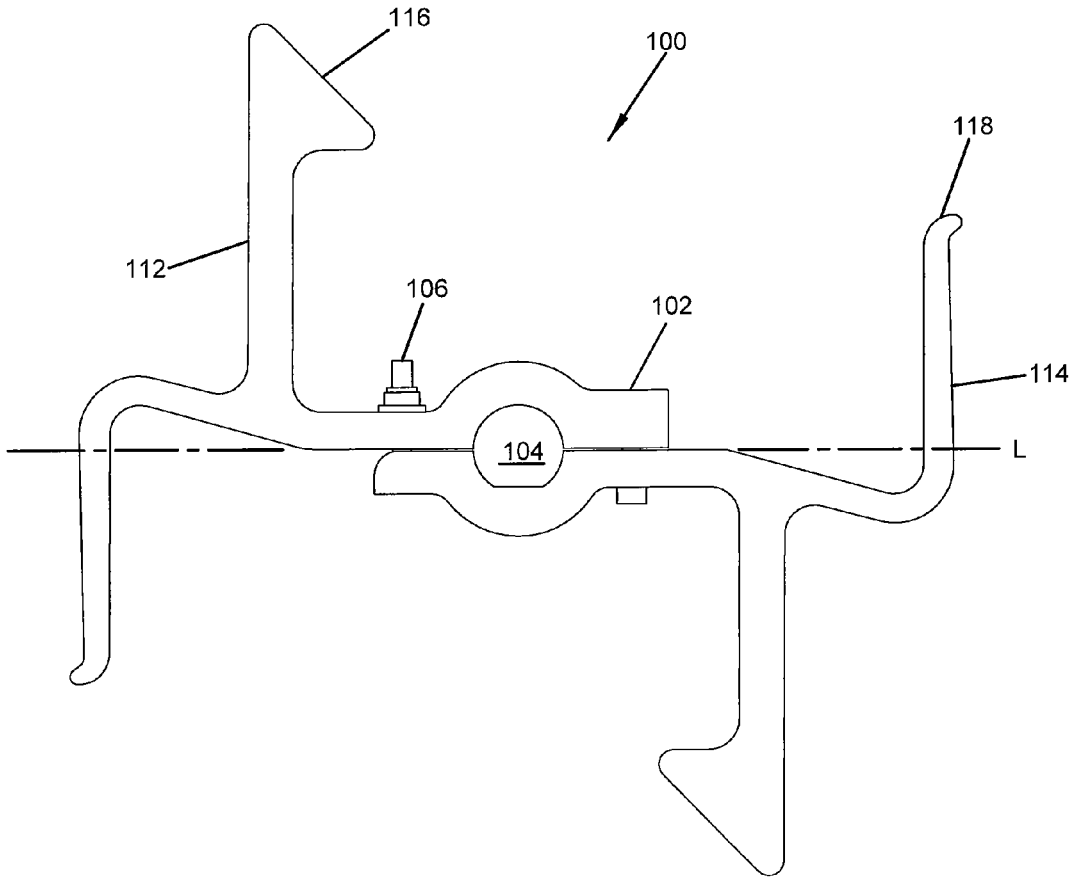
FIG. 4 is a side view of a folding tool according to some embodiments.
Figure 5:
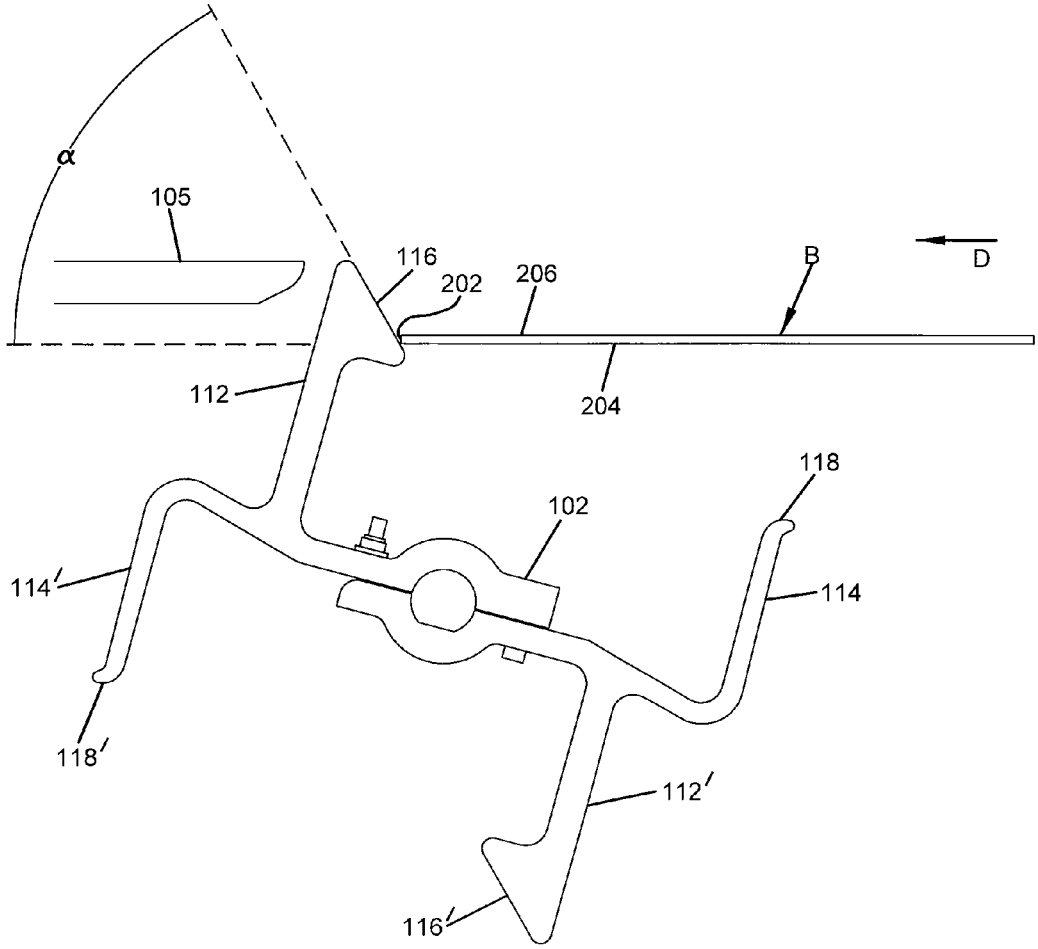
FIG. 5 is a side view of a folding tool in a first rotational position according to some embodiments.

FIG. 4 provides a side view of a folding tool 100 in accordance with some embodiments. Generally, the folding tool 100 may be configured for selective rotation to a plurality of predetermined rotational positions to contact portions of container blanks, such as the leading and trailing flaps, such that the flaps may be folded about their respective fold lines. In some embodiments, the folding tool 100 may include a base 102 which extends generally along a longitudinal axis L. The base 102 may define an opening 104 which extends through the base in a direction that is substantially transverse to the longitudinal axis L, and is sized and shaped for receiving an attachment structure, such as a shaft of the drive mechanism, to which the tool 100 is to be mounted. As shown, the base 102 may be formed as a two-part structure coupled via a suitable fastening mechanism 106. Alternatively, the base 102 may be formed from any number of parts. Such a multi-part structure may, for example, facilitate mounting of the tool 100 to a shaft of the drive mechanism.

In some embodiments, the folding tool 100 may include one or more working members 112, 114 extending outwardly from the base 102. Generally, the working members 112, 114 of the folding tool 100 may be configured such that both the leading and trailing flaps of a container blank may be folded about their respective fold lines, at least in part, through selective rotation of the folding tool 100 about a single rotational axis. The rotational axis may, for example, be defined by the shaft of the drive mechanism. As shown, the working members 112, 114 may be integrally formed to the folding tool 100. Alternatively, any of the working members 112, 114 may be separate components secured to the base 102 by a suitable connection method or combination of methods, including, but not limited to, press or snap fitting, clamping, welding, and the like. The working members 112, 114 can be formed from any suitably rigid material such as a metal or hard plastic.

In illustrative embodiments, the working members 112 may be configured and appropriately shaped for causing rotation of the leading edges of container blanks about their respective front fold lines (i.e., folding the leading flaps). As shown, the folding tool 100 may include a pair of working members 112 extending outwardly from the base 102 in substantially opposite directions at locations that are spaced apart from the opening 104. For example, the working members 112 may be spaced apart from the opening 104 substantially similar distances on opposite sides of the opening 104. The working members 112 may extend outwardly from the base 102 a direction which is substantially perpendicular to the longitudinal axis L. While the present disclosure it described with respect to embodiments in which the folding tool 100 includes a pair of working members 112, it is to be appreciated that any number of working members 112 may be employed such as, for example, one or three or more working members 112.

In various embodiments, the working members 112 may, at an end which is opposite the base 102, terminate in an impact surface 116. Impact surfaces 116, generally, are shaped to accommodate folding of the leading flaps of container blanks about their fold lines by striking of the flaps with the impact surfaces 116. In one embodiment, depicted in FIG. 4, the impact surfaces 116 may be substantially flat, and inclined with respect to the longitudinal axis L. The impact surfaces 116 may, upon contact with the leading edge of a container blank, cause the leading edge of a container blank to slide along the incline of the impact surface 116, thereby urging the leading edge above the board plane and causing folding of the leading flap about its fold line. Alternatively, impact surfaces 116 may be configured in any shape suitable for urging a leading flap of a container blank above the board plane. For example, the impact surfaces 116 may be configured to urge a leading flap above the board plane by striking a bottom surface of the leading flap.

In illustrative embodiments, the working members 114 may be configured and appropriately shaped for folding trailing flaps of container blanks about their respective fold lines. As shown, the folding tool 100 may include a pair of working members 114 extending outwardly from the base 102 in substantially opposite directions at locations that are spaced apart from the opening 104. Alternatively, any number of working members 114 may be included, such as one or three or more working members 114. As is also shown, each of the working members 114 may extend in substantially the same direction as one of the working members 112. The working members 114 may be provided spaced apart from the opening 104 substantially similar distances on opposite sides of the opening 104, such as at opposite ends of the base 102. The working members 114 may extend outwardly from the base 102 a direction which is substantially perpendicular to the longitudinal axis L. Thus, as shown, the folding tool 100 may include two pairs of working members 112, 114 provided spaced apart from the opening, and extending from the base 102 in substantially opposite directions. While the present disclosure it described with respect to embodiments in which the folding tool 100 includes two pairs of working members 112, 114, it is to be appreciated that any number of pairs of working members 112, 114 may be employed such as, for example, one or three or more pairs of working members 112, 114.

In various embodiments, the working members 114 may, at an end which is opposite the base 102, terminate in an impact surface 118 which is configured and appropriately shaped for folding trailing flaps of container blanks about their respective fold lines. For example, as shown, the impact surfaces 118 may be substantially rounded. Alternatively, impact surfaces 118 may be configured in any shape suitable for folding a trailing flap of a container blank about its fold line. Impact surface 118 also (or instead) may be fitted with an additional material, such as a rubber or plastic tip cover.

Regarding operation of the container forming assembly 10, in some embodiments, the folding tool 100 may be secured to and positioned on a rotatable shaft of the drive mechanism such that the folding tool 100 is within the gap G formed between the rails 31, 32 of the conveyor. The folding tool 100 may be further positioned on the shaft of the drive mechanism such that in at least one rotational position of the tool 100, at least a portion of one of the working members 112, 114 is positioned above the board plane, and in at least another rotational position of the tool 100, the working members 112, 114 are positioned below the board plane.

Figure 6:
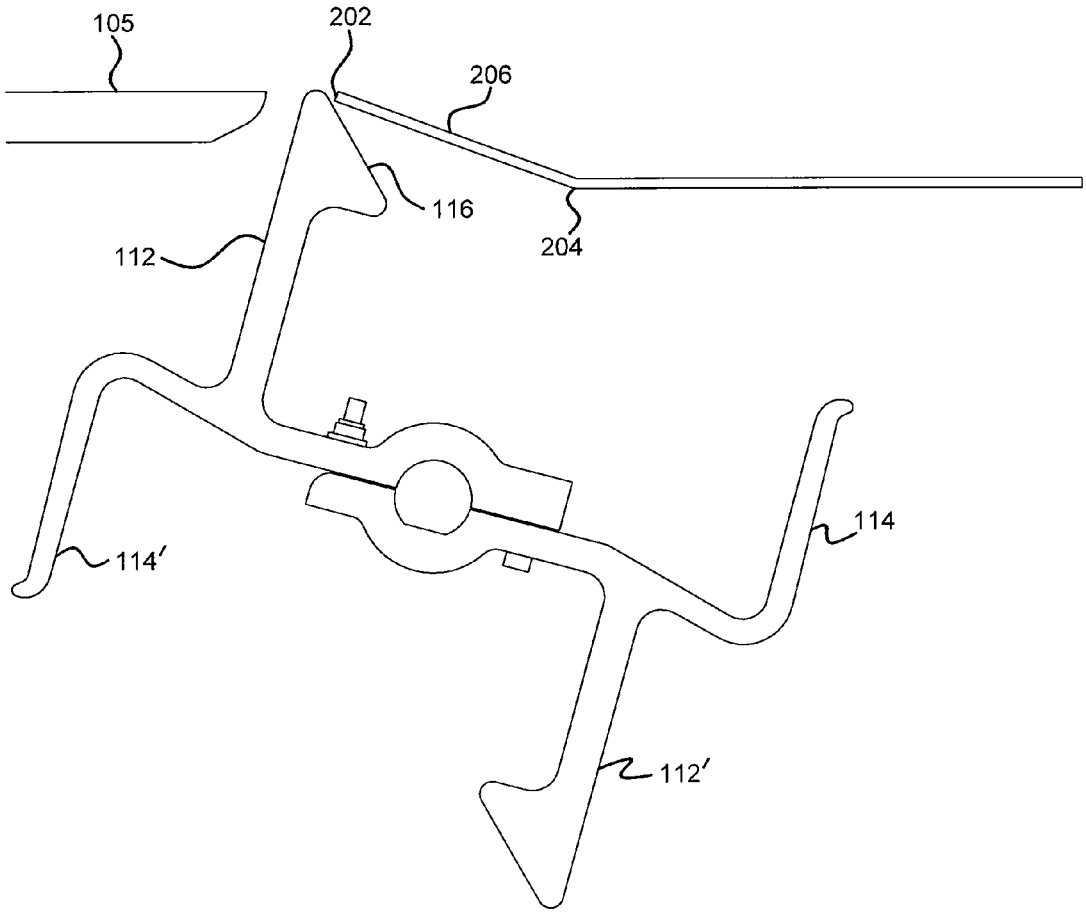
FIG. 6 is a side view of a folding tool in a first rotational position according to some embodiments.
Figure 7:
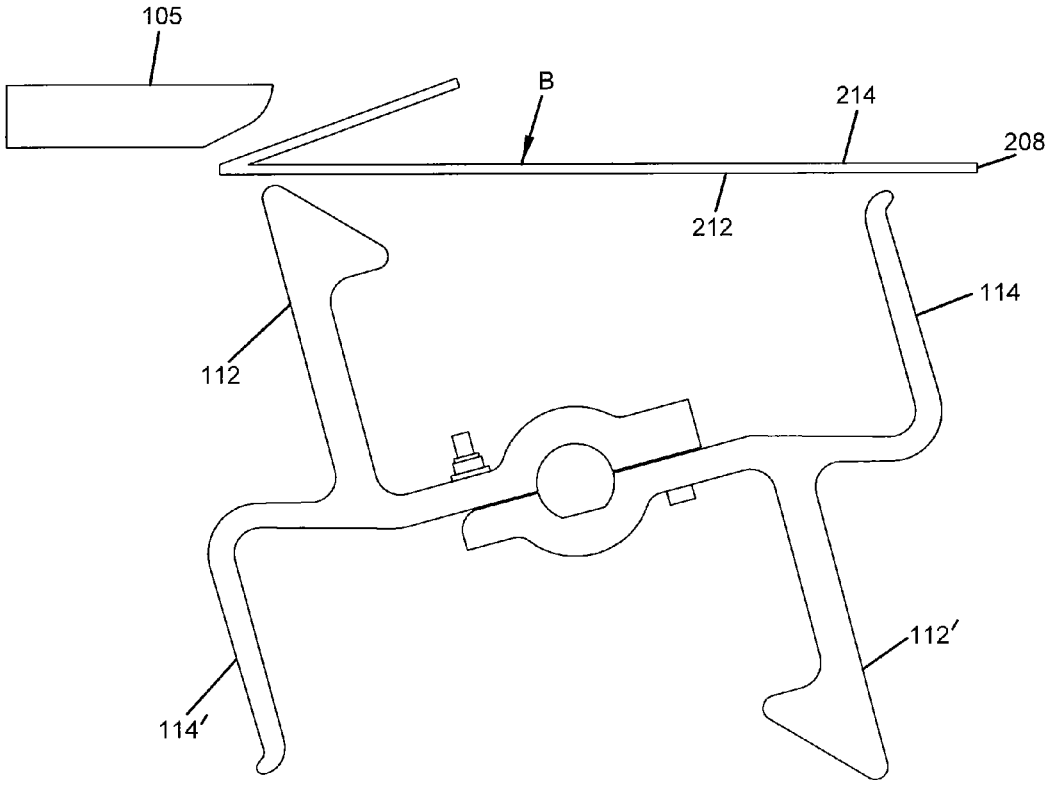
FIG. 7 is a side view of a folding tool in a second rotational position according to some embodiments.

FIGS. 5-9 depict side views of various rotational positions of the folding tool 100 relative to a container blank B according to some embodiments. Generally, in the embodiment of FIGS. 5-9, the folding 100 tool may be selectively rotated through a series of rotational positions, in the same direction, to facilitate folding of the leading and trailing flaps of container blanks. For purposes of distinguishing between the working members, the working members extending from the base 102 in a first direction are indicated as working members 112, 114 having working surfaces 116, 118 and the working members extending from the base 102 opposite the first direction are indicated as working members 112', 114' having impact surfaces 116', 118'. As shown, the container blank B, being transported on the conveyor 30 in the downstream direction D, may include a leading edge 202 and a fold line 204 defining a leading flap 206, and a trailing edge 208 and a fold line 212 defining a trailing flap 214 (FIG. 7).

In some embodiments, as the leading edge 202 of the container blank B approaches the folding apparatus 50, and thus the folding tool 100, the leading edge 202 may be detected by the sensors 40. In response, the folding tool 100 may be rotated into a first rotational position depicted in FIG. 5. Alternatively, the folding tool 100 may be provided initially in the first rotational position, such as by a mechanical or electronic timing device that is adapted or adjusted to correspond to the length of the container blank B and the speed of the conveyor 30. In the first rotational position, at least a portion of the impact surface 116 such as, for example, a lower portion of the impact surface 116, may intersect the board plane. As shown, in the first rotational position, the impact surface 116 may be inclined at an acute angle $\alpha$ with respect to the board plane. The container blank B may then advance in the downstream direction D and the leading edge 202 may strike the impact surface 116 and begin to slide along the incline, thereby lifting the leading flap 206 above the board plane, as depicted in FIG. 6. The position of the container blank B on the conveyor 30 relative to the folding tool 100 as its leading flap 206 contacts the impact surface 116 may be generally referred to as the first folding position. As the container blank continues advancing, the leading flap 206 may continue to rotate about the fold line 204. In one embodiment, additional tooling 105 shown schematically, such as stationary rails, poles, plates, or the like, may be provided above the conveyor 30 and contact the at least partially folded leading flap 206 as the container blank B continues in the downstream direction from the first folding position to further facilitate folding of leading flap 206 and/or hold the leading flap in a folded position. The folding tool 100 may then rotate in a first direction from the first rotational position to a second rotational position, as shown in FIG. 7. In the second rotational position, all of the working members, including their respective impact surfaces, may be provided below the board plane.

Figure 8:
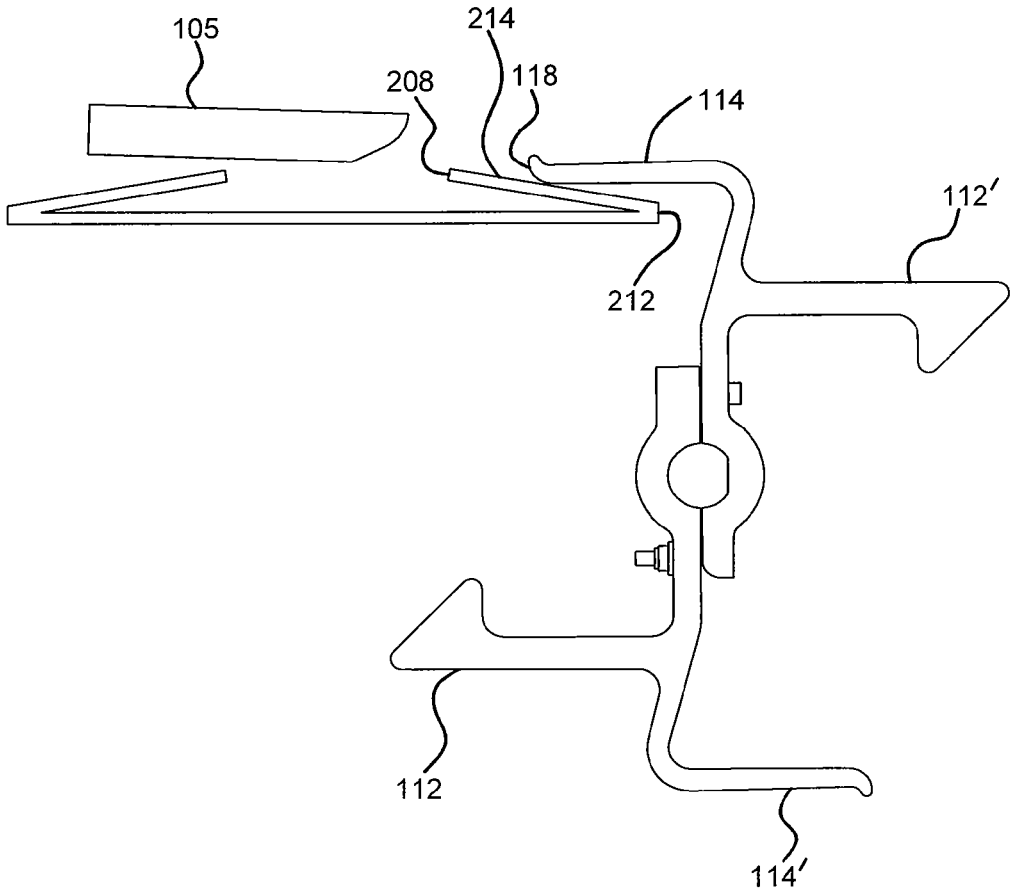
FIG. 8 is a side view of a folding tool in a third rotational position according to some embodiments.

The container blank B may then continue advancing in the downstream direction. At a point which may be determined, for example, based on the dimensions of the container blank B, the speed of the conveyor 30, and/or signals received from the sensors 40 regarding the position of the container blank B, the folding tool 100 may then rotate in the first direction from the second rotational position to a third rotational position, which is depicted in FIG. 8. The folding tool 100 also may be rotated by the electronic or mechanical timing described above. As the tooling rotates from second rotational position to the third rotational position, the impact surface 118 of the working member 114 may pass through the board plane, thereby striking the trailing flap 214 and lifting the trailing flap 214 above the board plane, thereby folding the folding the flap 214 about its fold line 212. The position of the container blank B on the conveyor 30 relative to the folding tool 100 as its trailing flap 214 contacts the impact surface 118 may be generally referred to as the second folding position. In one embodiment, as and/or after the trailing flap 214 is contacted by the working member 114, as with the leading flap 206, additional tooling provided above the conveyor 30 may contact the trailing flap 214 as the container blank B continues in the downstream direction to further facilitate folding of trailing flap 214 and/or hold the trailing flap 214 in a folded position. The container blank B may then continue advancing downstream for further processing with both of the leading flap 206 and trailing flap 214 folded and held.

Figure 9:
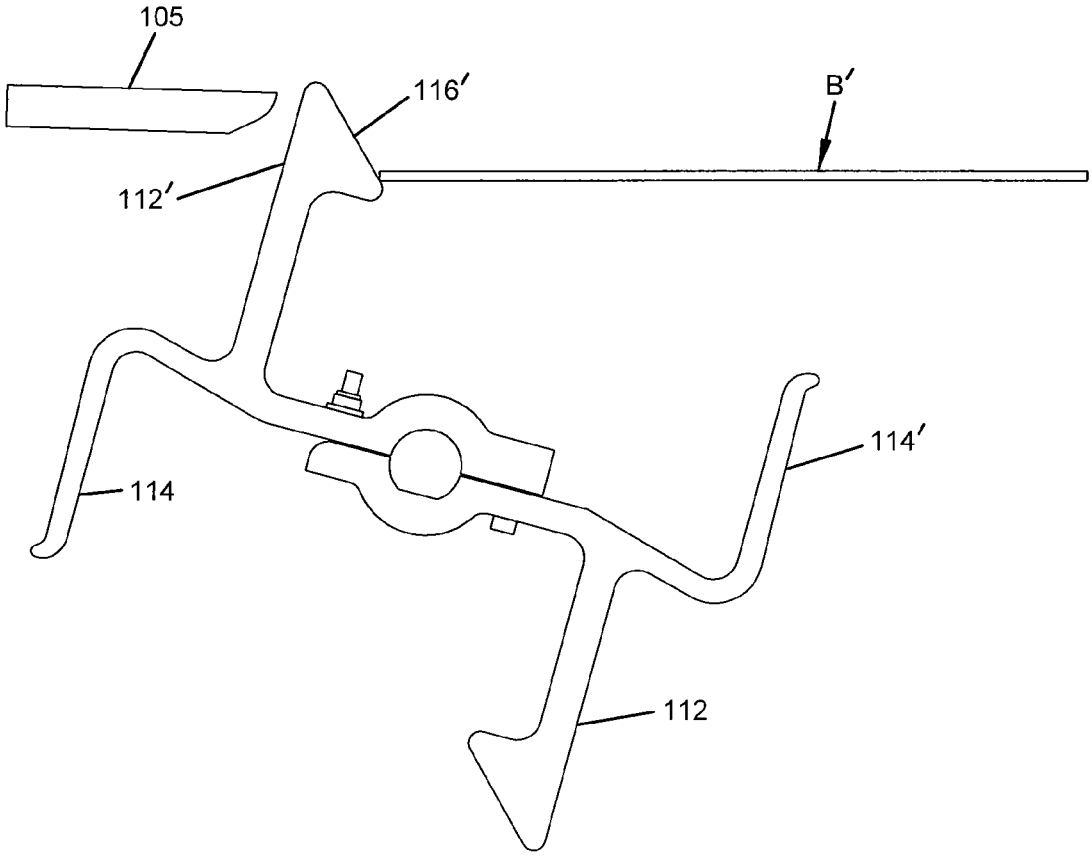
FIG. 9 is a side view of a folding tool in a fourth rotational position according to some embodiments.

In illustrative embodiments, prior to the arrival of another container blank B', the folding tool 100 may rotate in the first direction from the third rotational position to a fourth rotational position, which is depicted in FIG. 9. As shown in FIG. 9, in the fourth rotational position, the position of working member 112' and impact surface 116' may be substantially identical to that which the working member 112 and the impact surface 116 assumed in the first rotational position. For example, the folding tool 100 may be rotated in the first direction approximately 180 degrees from the first rotational position to the fourth rotational position. Alternatively, if the folding tool 100 includes only two working members (e.g., if working members 112' and 114' are eliminated), the folding tool may rotate in a second direction (which is opposite the first direction) from the third rotational position to a position that substantially corresponds to the first rotational position. It is to be appreciated that the folding tool 100 may cycle through the rotational positions described above to fold the leading and trailing flaps of the container blank B', and subsequent container blanks.

Figure 12:
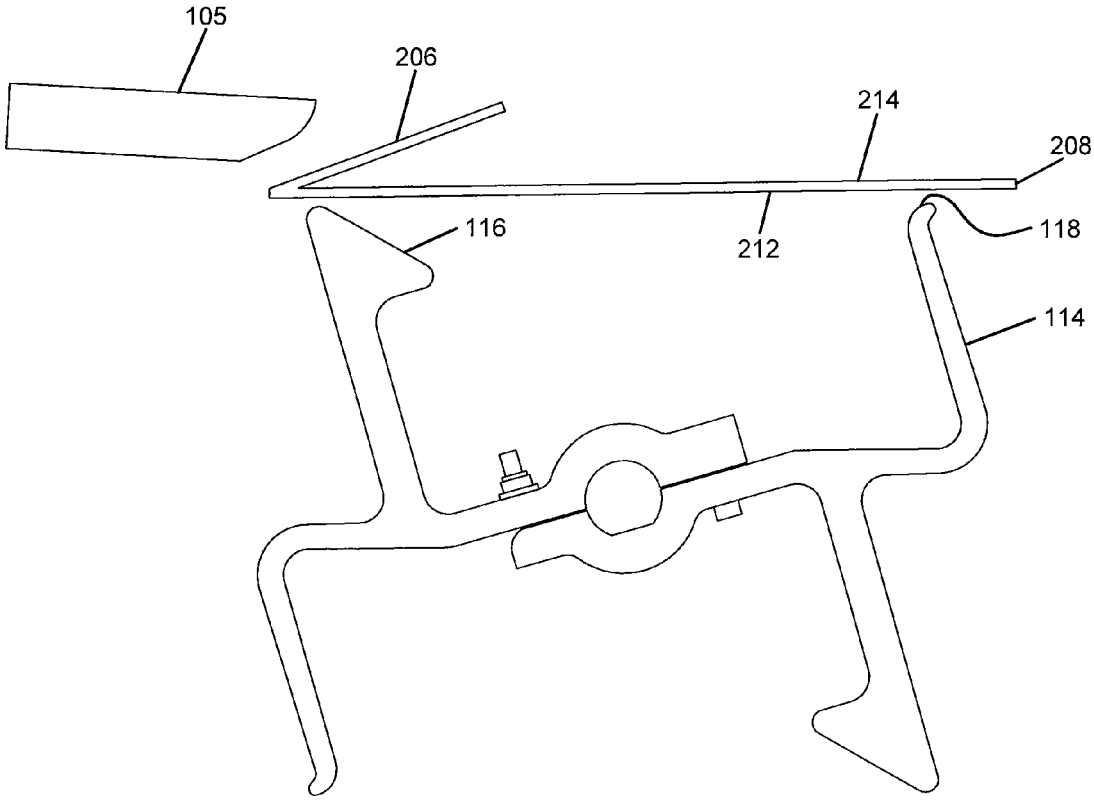
FIG. 12 is a side view of a folding tool in a third rotational position according to some embodiments.

FIGS. 10-14 depict side views of various rotational positions of the folding tool 100 relative to a container blank B according to an alternative embodiment. Generally, in the embodiment of FIGS. 10-14, the folding 100 tool may be selectively rotated in two rotational direction through a series of rotational positions to facilitate folding of the leading and trailing flaps of container blanks. In this embodiment, as the leading edge 202 of the container blank B approaches the folding the folding tool 100, the folding tool may be provided in a first rotational position (FIG. 10), in which all of the working members are provided below the board plane, and particularly, the impact surface 116 of working member 112 is positioned just below the board plane. Upon the leading flap 206 of the container blank B passing above the impact surface 116, the folding tool 100 may be rotated in a first direction (hereinafter clockwise) to a second position (FIG. 11) in which the impact surface 116 is positioned above the board plane, thereby striking the leading flap 206 and urging the leading flap 206 above the board plane (i.e., at least partially folding the leading flap 206 about the fold line 204). As discussed above, it is to be appreciated that the folding tool may be prompted to rotate in response to signal received from sensors 40 and/or a mechanical or electronic timing device that is adapted or adjusted to correspond to the length of the container blank B and/or the speed of the conveyor 30. As the container blank B advances in the downstream direction D, the leading flap 206 may continue to rotate about the fold line 204 before being captured by the tooling 105 provided above the conveyor 30, which holds the leading flap 206 in a folded position. The folding tool 100 may then rotate in a second direction (hereinafter counterclockwise) from the second position to a third position (FIG. 12). As with the first position (FIG. 10), in the third position, all of the working members, including their respective impact surfaces, may be provided below the board plane. In one embodiment, the first position of the folding tool 100 is substantially the same position as the third position.

Figure 13:
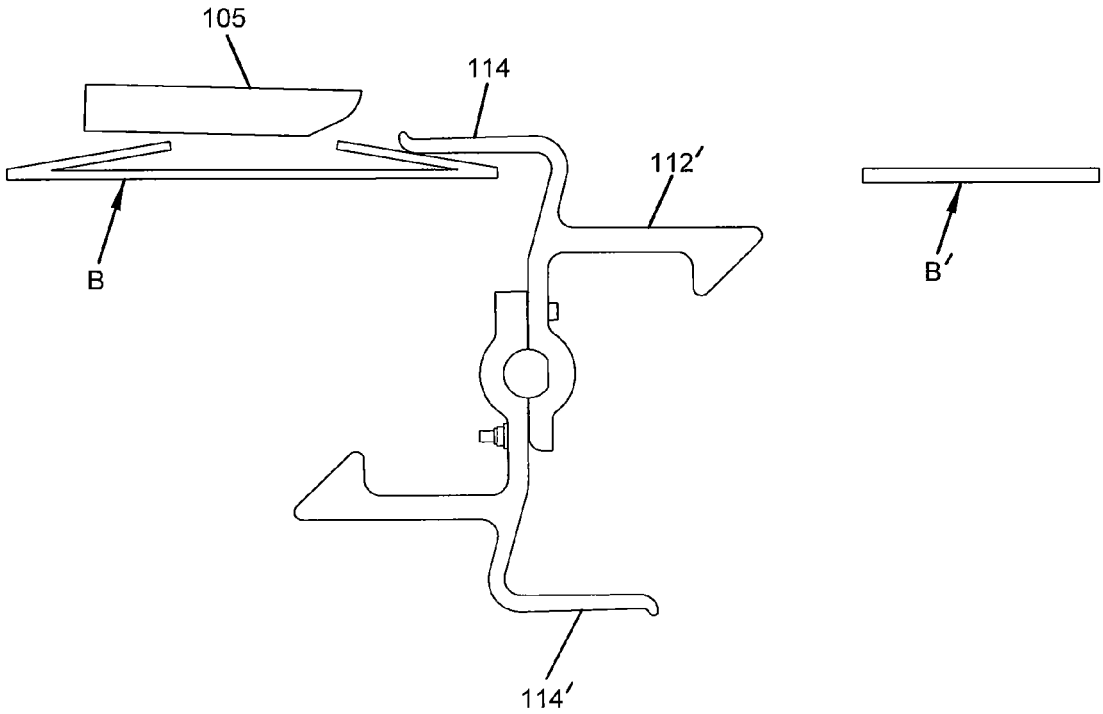
FIG. 13 is a side view of a folding tool in a fourth rotational position according to some embodiments.

The container blank B may then continue advancing in the downstream direction. Upon the trailing flap 214 passing above the working member 114, which may be determined, for example, based on the dimensions of the container blank B, the dimensions of the flaps of the container blank, the speed of the conveyor 30, and/or signals received from the sensors 40, the folding tool 100 may then rotate counterclockwise from the third position to a fourth position (FIG. 13). Such rotation may cause the impact surface 118 of the working member 114 to strike the trailing flap 214 and urge the trailing flap 214 above the board plane (i.e., at least partially folding the trailing flap 214 about the fold line 212). As and/or after the trailing flap 214 is contacted by the working member 114, as with the leading flap 206, the tooling 105 may capture the trailing flap 214 as the container blank B continues in the downstream direction thereby hold the trailing flap 214 in a folded position. The container blank B may then continue advancing downstream for further processing with both of the leading flap 206 and trailing flap 214 folded and held.

Figure 10:
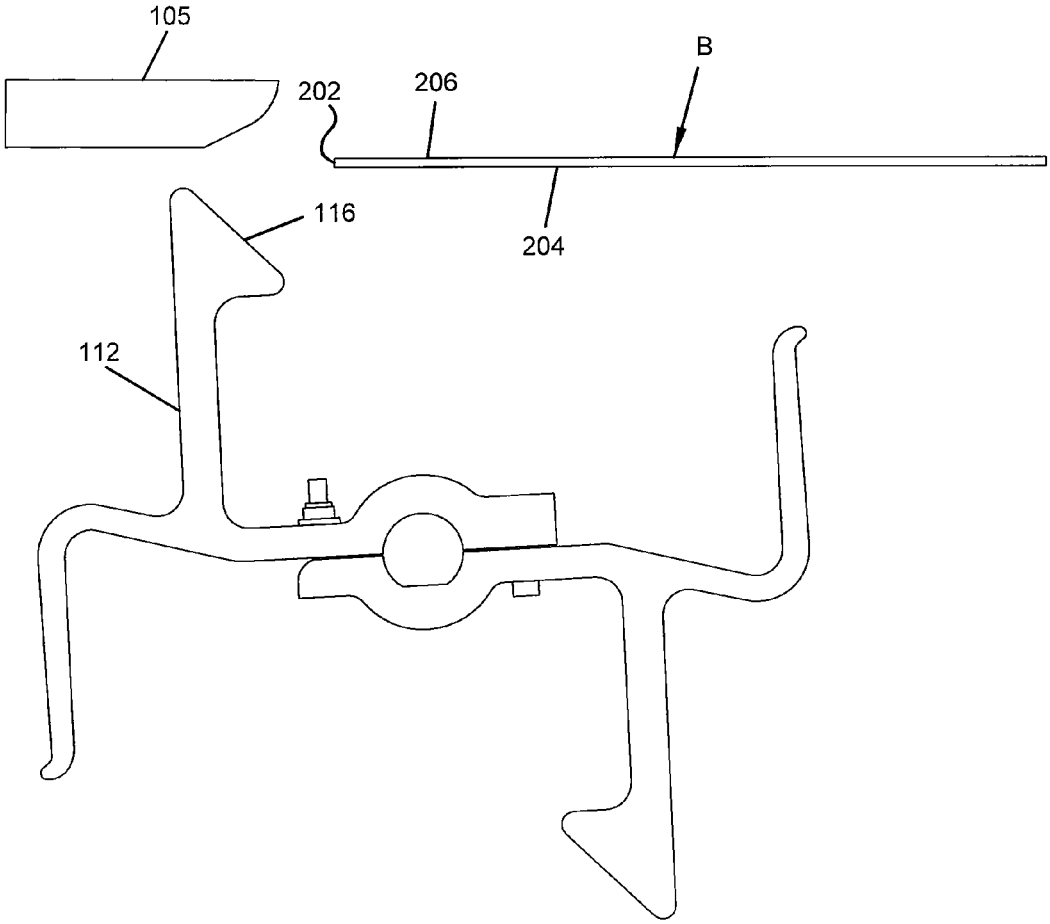
FIG. 10 is a side view of a folding tool in a first rotational position according to some embodiments.
Figure 11:
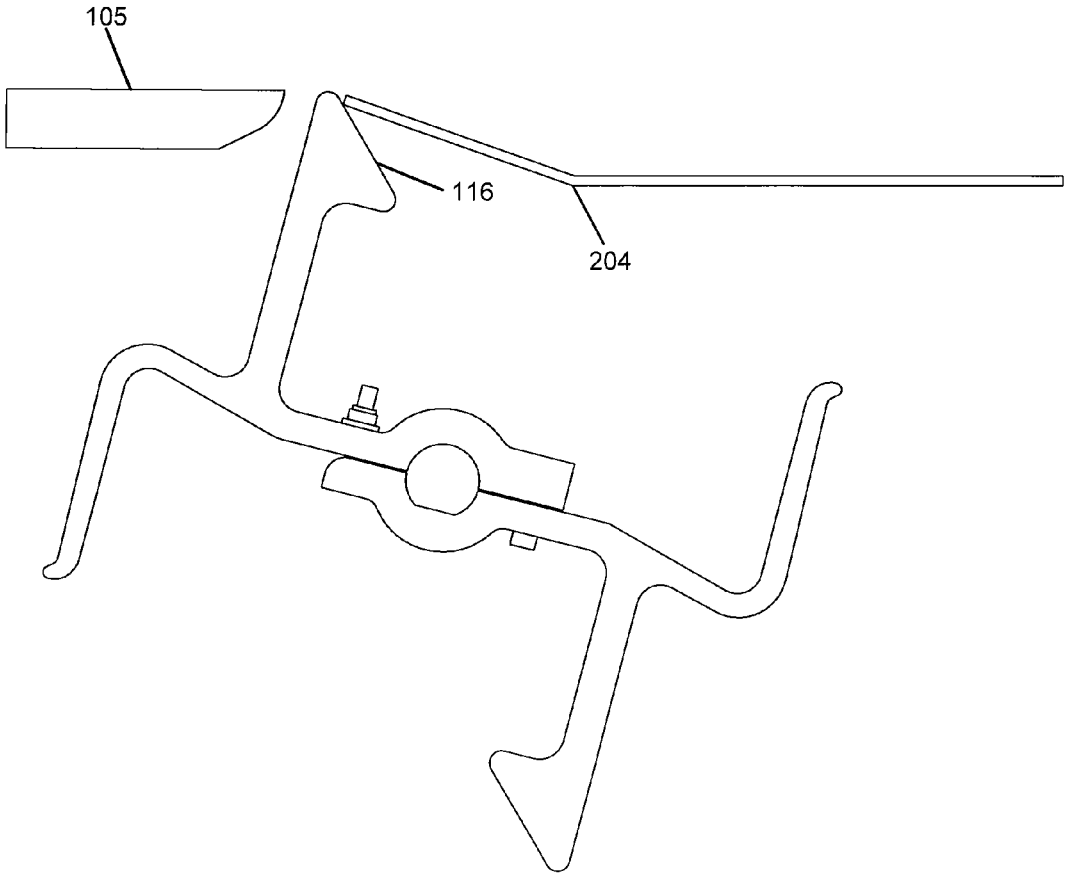
FIG. 11 is a side view of a folding tool in a second rotational position according to some embodiments.
Figure 14:
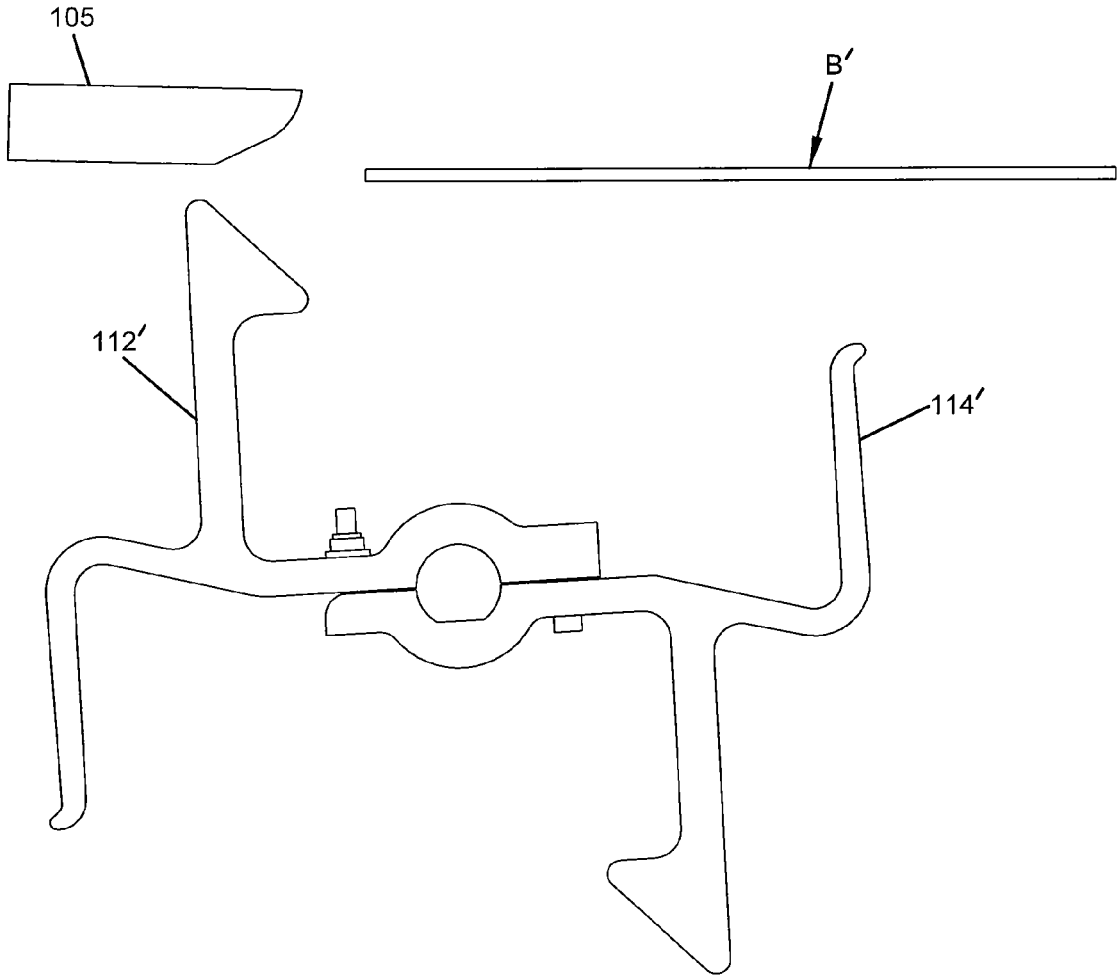
FIG. 14 is a side view of a folding tool in a fifth rotational position according to some embodiments.

In one embodiment, prior to the arrival of another container blank B', the folding tool 100 may rotate counterclockwise from the fourth position to a fifth position (FIG. 14). In the fifth rotational position, the position of working member 112' and impact surface 116' may be substantially identical to that which the working member 112 and the impact surface 116 assumed in the first or third positions (FIG. 10 or FIG. 12). Alternatively, if the folding tool 100 includes only two working members (e.g., if working members 112' and 114' are eliminated), the folding tool may be rotated clockwise from the fourth position to a position that substantially corresponds to the first position or the third position. It is to be appreciated that the folding tool 100 may cycle through the rotational positions described above to fold the leading and trailing flaps of the container blank B', and subsequent container blanks.

In some embodiments, the folding tool 100 may be employed to fold leading flaps only, trailing flaps only. For example, in instances where the folding tool 100 is employed to fold only leading flaps, the folding tool 100 may cycle between a first rotational position (e.g., FIG. 7, 10, or 14) and a second rotational position (e.g., FIG. 5 or 11). In instances where the folding tool is employed to fold only trailing flaps, the folding tool 100 may cycle between a first rotational position (e.g., FIG. 7, 10, or 14) and a second rotational position (FIG. 8 or 13).

Although the present invention has been described with reference to preferred embodiments, persons skilled in the art will recognize that changes may be made in form and detail without departing from the spirit and scope of the invention.

I claim:

1. A folding system for folding a generally flat container blank having a plurality of edges and fold lines therein for defining a leading flap and a trailing flap, the folding system comprising:

a conveyor having a conveying surface configured for conveying the blank along a predetermined path to a first folding position and a second folding position;

a folding apparatus configured for contacting the blank and folding the leading and trailing flaps, the folding apparatus comprising a drive assembly and a folding tool, wherein the drive assembly comprises a drive mechanism operatively coupled to a rotatable shaft; and wherein the folding tool is secured to the rotatable shaft;

a control system operatively coupled to the folding apparatus and operable to control movement of the folding tool between a first rotational position and a second rotational position, wherein rotation of the folding tool to the first rotational position causes the leading flap of the container blank positioned in the first folding position to fold about a leading flap fold line, and rotation of the folding tool from the first rotational position to the second rotational position causes the trailing flap of the container blank positioned in the second folding position to fold about a trailing flap fold line.

2. The folding system of claim 1, further comprising a sensor system operatively coupled to the control system, the sensor system including a sensor disposed proximate the folding apparatus operable to detect the position of the container blank.

3. The folding system of claim 1, wherein the folding tool comprises a base, a first working member, and a second working member, wherein the first and second working members extend outwardly from the base in substantially the same direction.

4. The folding system of claim 3, wherein an end of the first working member that is opposite the base comprises a first impact surface, and wherein the first impact surface is angled with respect to a longitudinal dimension of the base.

5. The folding system of claim 4, wherein a board plane is defined by an unerected container blank lying substantially flat on the conveyor, and wherein in the first rotational position, the first impact surface intersects, and is inclined at an acute angle with respect to, the board plane.

6. The folding system of claim 5, wherein an end of the second working member that is opposite the base comprises a second impact surface, and wherein rotation of the folding tool from the first rotational position to the second rotational position causes the second impact surface to pass through the board plane.

7. The folding system of claim 6, wherein the folding tool further comprises a third working member and a fourth working member extending outwardly from the base in a direction which is generally opposite the direction in which the first and second working members extend from the base.

8. The folding system of claim 6, wherein the second folding position is downstream from the first folding position.

* * * * *